US006615756B2

(12) United States Patent
Barrus

(10) Patent No.: US 6,615,756 B2
(45) Date of Patent: Sep. 9, 2003

(54) ADJUSTABLE, LIGHTWEIGHT, COLLAPSIBLE QUILTING APPARATUS AND METHODS FOR USING SAME

(76) Inventor: Laurel W. Barrus, 322 E. 500 North, Centerville, UT (US) 84014

( * ) Notice: Subject to any disclaimer, the term of this patent is extended or adjusted under 35 U.S.C. 154(b) by 0 days.

(21) Appl. No.: 10/003,984

(22) Filed: Oct. 31, 2001

(65) Prior Publication Data

US 2003/0079666 A1 May 1, 2003

(51) Int. Cl.[7] ..... D05B 11/00
(52) U.S. Cl. ..... 112/119
(58) Field of Search ..... 112/117, 118, 112/119, 102, 470.12, 470.31, 470.33, 303, 304, 305, 307, 475.07, 475.08; 38/102, 102.21, 102.4, 102.6, 102.8

(56) References Cited

U.S. PATENT DOCUMENTS

| | | | | |
|---|---|---|---|---|
| 3,190,247 | A | * | 6/1965 | Schifano et al. |
| 3,312,184 | A | * | 4/1967 | Cash |
| 4,192,241 | A | | 3/1980 | Reed et al. |
| 4,557,206 | A | | 12/1985 | Iwase |
| 4,944,105 | A | * | 7/1990 | Schulle |
| 5,027,726 | A | * | 7/1991 | Brower et al. |
| 5,103,747 | A | | 4/1992 | Resta et al. |
| 5,136,955 | A | | 8/1992 | Resta et al. |
| 5,167,195 | A | | 12/1992 | Guerreschi |
| 5,182,998 | A | | 2/1993 | Iwase |
| 5,711,098 | A | | 1/1998 | Warne |
| 5,870,840 | A | * | 2/1999 | Geils et al. |
| 5,913,275 | A | | 6/1999 | Flynn |
| 6,079,341 | A | | 6/2000 | Resta |
| 6,123,038 | A | | 9/2000 | Kames et al. |
| 6,151,816 | A | | 11/2000 | Bagley |

OTHER PUBLICATIONS

Handi Quilter, "Handi Quilter tm Introduces the New HQ Sixteen!", 2002–2003 (earliest model mention date—May 2001), from www.handiquilter.com.*

Pennywinkle Valley Ranch, "Creators fo the Original Home Quilting System, Penneywinkle Valley Ranch", 2002–2003, (Penneywise II Table Top Frame pricelist), from www.penneywinklevalleyranch.com.*

* cited by examiner

*Primary Examiner*—Ismael Izaguirre
(74) *Attorney, Agent, or Firm*—Madson & Metcalf

(57) ABSTRACT

A quilting apparatus and method for guiding a sewing machine relative to at least one layer of fabric is disclosed in one presently preferred embodiment including an adjustable quilting frame and a carriage assembly configured to mountably support the sewing machine having an arbitrary throat depth. Preferably, the quilting frame is mounted relative to a working surface and supportably retains one or more fabric layers in a substantially planar orientation to accommodate the sewing and stitching of patterns and/or designs into at least a portion of the fabric layers forming the quilt. The carriage assembly may be configured to transport the sewing machine in both lateral and longitudinal directions with respect to the quilting frame. Preferably, the carriage assembly includes a lower carriage component disposed on a first track configured to transport the sewing machine along the longitudinal dimension of the quilting frame and an upper carriage component disposed on a second track relative to the upper surface of the lower carriage component and configured to transport the sewing machine along the lateral dimension of the quilting frame. The quilting frame includes support members acting as spools in relation to the fabric layers and having locking mechanisms associated therewith for maintaining a sufficient amount of tension in the body of the fabric layers. Preferably, the support members are configured having an adjustable length to accommodate various sizes and dimensions of the fabric layers forming the quilt and to accommodate the arbitrary dimensions of the working surface upon which the quilting frame is mounted. The height of the quilting frame may also be adjusted with respect to the working surface by means of a height adjustment assembly.

36 Claims, 6 Drawing Sheets

ADJUSTABLE, LIGHTWEIGHT, COLLAPSIBLE QUILTING APPARATUS AND METHODS FOR USING SAME

BACKGROUND

1. The Field of the Invention

This invention relates to quilting devices and, more particularly, to novel apparatus and methods for quilting using sewing machines having an arbitrary throat depths, wherein the sewing machine is supportably positioned on a movable frame having a quilt engageably positioned in relation thereto.

2. The Background Art

Throughout American history, quilting has been a popular pastime. The craft today has experienced a resurgence in popularity and enjoys immense participation by hobbyists in quilting shows, magazines, newsletters, clubs, societies, and the like. Although traditional quilt making may be at the root of this resurgence, the development of modern textiles, machinery, and labor-saving sewing devices may be contributing to this resurgence, as many activities compete for the time of the average hobbyist or craftsperson.

Quilting typically involves stitching together multiple layers of fabric to form, in a manner of speaking, a new fabric. In some instances, quilting may include sewing together a myriad of smaller pieces of fabric to form a single composition fabric or material. A quilt typically includes an upper and lower layer of fabric having a layer of batting introduced therebetween for thickness, padding and/or warmth. As appreciated, quilts may be created in various shapes and sizes, such as for example, from small and ornamental, to those that cover large beds, or those that are mounted to decorate walls.

Designs or patterns are usually sewn or stitched into a quilt by hand or with a sewing machine, thereby adding an artistic element to the craft of quilt making. Some designs or patterns may be very elaborate, thus requiring a high degree of skill and dexterity on the part of the craftsperson or hobbyist. In some cases, sewing machines may be equipped with preprogrammed stitching patterns to assist in performing these tasks more accurately and with a greater degree of intricateness than quilting by hand. More importantly, extravagant quilting generally incorporates elaborate designs that may require many hours of work even by the most skilled craftsperson.

Due to the extensive time commitment realized by atypical quilter using hand-sewing methods to produce a quilt for a bed or for a decorative wall hanging, those skilled in the art developed industrial quilting assemblies for use in producing quilts in high quantities. These types of industrial quilting assemblies typically include heavy duty, bulky sewing machines disposed in a stationary position wherein the subject quilt, mounted on a quilting frame, is moved relative to the head of the sewing machine. A significant disadvantage with these types of prior art industrial quilting assemblies is the elaborate work area required to move and position the quilting frame supporting the layers of quilting material relative to the stationary head of the sewing machine. In particular, a very wide and long work space is generally required since the movement of the quilting frame relative to the head of the sewing machine may encompass twice the width and length of the support frame itself.

Household sewing machines have resulted in both tremendous time-savings and quality improvements over traditional hand-sewing methods. Nevertheless, manipulating large quilts with respect to stationary sewing machines is typically a cumbersome and laborious process. "Long arm" quilting machines were developed by those skilled in the art, in part, to address the problems associated with manipulating large quilts when stitching the multiple layers of the quilt together. In particular, instead of moving a quilting frame supporting a quilt with respect to a sewing machine, the quilting frame may be maintained stationary and the sewing machine may then be moved with respect to the width of the quilt. In order to accomplish this task successfully, a support frame is generally needed to maintain the quilt in a substantially planar configuration, and a carriage system may be needed to move the sewing machine with respect to the length and width of the quilt.

Unfortunately, "long arm" sewing machines of the prior art are usually complex in configuration, bulky, heavy, inflexible, and usually unaffordable to the typical consuming hobbyist or quilting craftsperson. As appreciated by those skilled in the art, commercial "long arm" sewing machines may cost upwards of several thousand dollars, making them generally out of reach and impractical to many quilting hobbyists. Moreover, specially designed "long arm" sewing machines and fixed frame assemblies are typically required to provide means for quilting using prior art quilting assemblies, thereby making a hobbyist's household sewing machine practically unusable in the task. In addition, many of the prior art quilting assemblies cannot perform desired stitching or sewing since the maneuverability of the head of the sewing machine is affected by its own mechanical and structural restrictions.

Conventional household sewing machines, which are generally intended to remain stationary when being used for sewing, typically include many of the stitching functions necessary for quilting, but may simply lack the wherewithal to be accurately movable with respect to the dimensional length and width of a quilt so as to accomplish the appropriate stitching and/or creative stitching designs desired by the user. In addition, quilting assemblies of the prior art require special tables or frames to support a sewing machine in relation thereto and to provide the appropriate tracking mechanisms necessary to manipulate the sewing machine in relation to the layers of material forming the quilt, thereby increasing the expense and bulkiness of these prior art systems and making ordinary tables unworkable in connection therewith.

In addition to the foregoing, work space is typically an issue to the average hobbyist or quilting craftsperson. Particularly, bulky "long arm" sewing machines usually require large work areas and may be unsightly and awkward if located in areas of an individual's home, such as a family room, den, dining room, bedroom, or living room. Moreover, finding sufficient space to store conventional prior art "long arm" sewing machines and quilting assemblies between uses typically poses a significant storage problem to the average hobbyist or craftsperson.

As appreciated, since quilts may take on a wide variety of dimensional sizes and shapes depending upon the use for which the quilt is being made, the fixed-size quilting assemblies of the prior art typically prove to be too large, bulky, and generally awkward for use with smaller quilts, while not being sufficiently expandable nor adjustable in order to accommodate a larger or, in the alternative, a smaller quilting project. Accordingly, the fixed-size quilting assemblies of the prior art are typically structurally fitted to support a particular sized quilt by means of a fixed length quilting support frame.

Space limitations that are imposed by a family room, den, dining room, bedroom or living room may further require a quilting assembly to be sufficiently adjustable to accommodate the dimensions of the available work space. Thus, fixed-size quilting assemblies of the prior art that are mounted to a support frame or structure (e.g., working surface or table having a fixed length and width) may be too cumbersome for the available workspace and thereby restrict the working area required for quilting.

The working components of prior art quilting assemblies have also been found be heavy, bulky in size, and generally awkward for the average hobbyist or craftsperson to handle or move. Therefore, a quilting apparatus having a functional and structural design that is adjustable in terms of size and configuration, collapsible for storage, sufficiently lightweight for easy portability, and which provides ease of handling are important features and characteristics to users of such quilting systems. Such a quilting apparatus and methods for using the same of which the above-referenced disadvantages of the prior art quilting assemblies are substantially eliminated is disclosed herein.

BRIEF SUMMARY AND OBJECTS OF THE INVENTION

In view of the foregoing, it is a primary object of the present invention to provide a quilting apparatus having many of the advantages of "long arm" quilting assemblies, while providing a greater degree of simplicity, affordability, and flexibility to a user.

It is also an object of the present invention to provide a quilting apparatus that makes use of a sewing machine of arbitrary throat depth being positionable on a carriage assembly and which is capable of providing the sewing or stitching mechanism for the quilt.

It is a further object of the present invention to provide a quilting apparatus having a quilting frame that is mountable to a wide variety of ordinary table tops having different dimensions, wherein the quilting frame is adjustable in its overall dimensional width and length with respect to the table top.

It is another object of the present invention to provide a quilting apparatus that is sufficiently lightweight for portability and collapsible for easy storage.

Consistent with the foregoing objects, and in accordance with the present invention as embodied and broadly described herein, a method and apparatus are disclosed in one presently preferred embodiment of the present invention as including a quilting frame and a sewing machine carriage assembly. The quilting frame may include two opposing end plates and one or more elongated support members disposed between the two opposing end plates. A locking assembly selectively engages at least one of the ends of the support member in such a manner so as to retain the fabric or material comprising the quilt sufficiently tensioned between each of the support members.

In one presently preferred embodiment of the present invention, the elongated support members may be configured having an extendable length or, in the alternative, a fixed length. Preferably, the support members of the quilting frame comprise one or more poles or spools. At least two, and preferably three or more support members supportably engage a portion of the length of the opposing end plates of the quilting frame at a spaced-apart relationship therebetween. The elongated support members are preferably adjustable in length in relation to the disposition of the opposing end plates to accommodate fabrics of various dimensions.

A carriage assembly may be used to maneuver a sewing machine with respect to the length and width of the quilt supportably mounted between the support members of the quilting frame. In one presently preferred embodiment, the carriage assembly may include upper and lower carriage components that are capable of manual and/or automated manipulation to facilitate the maneuverability of the sewing machine in both lateral and longitudinal directions respective to the quilting material. Tracks may be used to retain the upper and lower carriage components properly aligned in relation to each other. In addition, a length of track may be used to keep the carriage assembly properly aligned on a table top or other working surface.

A quilting apparatus made in accordance with one presently preferred embodiment of the present invention includes a quilting frame configured to selectively take up and pay out or deliver one or more pieces of fabric comprising a quilt, while maintaining the fabric in a substantially planar orientation defined by lateral and longitudinal dimensions. Consistent with the novel adjustable working components of the quilting apparatus of the present invention, the quilting frame may be mountable to any suitable working surface having an arbitrary length and providing a substantially smooth upper surface. In fact, the working surface may include a table top or any other surface of arbitrary length. The longitudinal dimension of the quilting frame may therefore be adjustable to the length of the working surface or table top, as desired.

More particularly, in one presently preferred embodiment of the present invention, the carriage assembly is configured to transport a sewing machine of arbitrary throat depth along the width of one or more pieces of fabric comprising a quilt, wherein the quilt has a length which supportably engages elongated support members of a quilting frame mounted in relation to a suitable working surface (e.g., table top). The sewing machine, as contemplated herein, may include a wide variety of conventional sewing machines currently available in the marketplace. Functionally, the carriage assembly provides means for moving the sewing machine with respect to the quilting fabric, along both the lateral and longitudinal dimensions thereof, for the purpose of applying stitching to at least a portion of the quilt.

In certain presently preferred embodiments, the carriage assembly includes an upper carriage component and a corresponding lower carriage component. The lower carriage component may be responsible for selectively transporting the sewing machine along the longitudinal dimension of the quilting frame. With respect thereto, the upper carriage component may preferably move along an upper surface of the lower carriage component and be configured to selectively transport the sewing machine along the lateral dimension of the quilting frame. As will be appreciated, in one presently preferred alternate embodiment of the present invention, the carriage assembly does not include upper and lower carriage components, but rather is formed as a single, unitary member, translatable with respect to both the later and longitudinal dimensions of the fabric comprising the quilt supportably engaging the elongated support members of the quilting frame.

A track may be mounted on the working surface or table top in order to restrict the movement of the lower carriage component in a predefined direction along the longitudinal dimension of the quilting frame. In one presently preferred embodiment of the present invention, the track may be provided in segments, thereby allowing a user to adjust the length of the track according to the corresponding width of the fabric comprising the quilt. In addition, a second track may be formed on the upper surface of the lower carriage component to guide the upper carriage component in a predefined directional relation thereto. For example, the second track may be formed in such a manner so as to restrict the movement of the upper carriage to the direction defined by the lateral dimension of the quilting frame and may further comprise end stops or abutments to prevent the upper carriage component from becoming unexpectedly disengaged from its relation to the lower carriage component.

The first track may include a recess formed along at least a portion of the length of its upper surface. The recess being configured with a dimensional periphery sufficient to engageably retain a portion of a wheel or caster of the lower carriage assembly therein. Alternatively, a rib may be formed along at least a portion of the length of the upper surface of the first track. The rib being configured with a dimensional periphery sufficient to engageably retain a corresponding portion of a wheel or caster of the lower carriage assembly in relation thereto.

Preferably, wheels or casters may be incorporated into the structural design of the upper and lower carriage components to allow the carriage assembly to be translated in two dimensions. As discussed hereinabove, guides may be formed along the length of the track to retain the wheels or casters within a desired area or line of engagement, thus preventing the carriage assembly from becoming disengaged from its mountable relationship with the working surface or table top.

Similarly, the lower carriage assembly may include a recess formed along at least a portion of the length of its upper surface. The recess being configured with a dimensional periphery sufficient to engageably retain a portion of a wheel or caster of the upper carriage assembly therein. Alternatively, a rib may be formed along at least a portion of the length of the upper surface of the lower carriage assembly. The rib being configured with a dimensional periphery sufficient to engageably retain a corresponding portion of a wheel or caster of the upper carriage assembly in relation to the lower carriage assembly.

An apparatus and method in accordance with the present invention may also include at least two opposing end plates extending along the lateral dimension of the quilting frame. The two opposing end plates are preferably configured to engage the opposing ends of the support members, respectively, thus providing rotation points for the support members when taking up or paying out the supported fabric or material comprising the quilt. The positioning of the opposing end plates of the quilting frame further provides means for maintaining a constant spaced-apart relationship between each of the elongated support members.

The opposing end plates of the quilting frame may be supported by a height adjustment assembly. In one presently preferred embodiment of the present invention, the height adjustment assembly comprises at least one leg supporting each of the opposing end plates. The support legs may be formed having a length sufficient to facilitate an adjustment in the height of the quilting frame with respect the working surface (e.g., table top). Preferably, each support leg may be formed having a general L-shaped configuration. Each of the support legs may be structurally disposed in relation to at least a portion of the length of a respective end plate and may be secured to the working surface by means of a securing assembly. In certain embodiments, the securing assembly may include a clamp or bolt having arms that engage the support leg of the quilting frame and the working surface (e.g., table top).

Preferably, the support legs may be adjustably attached to the respective end plates of the quilting frame, thus permitting the quilting frame to be height adjusted with respect thereto. In certain preferred embodiments, each of the support legs may comprise a slotted opening formed along a portion of its length, thus allowing the corresponding end plate of the quilting frame to selectively slide along the length of the slotted opening. A friction knob or other suitable adjustment mechanism may be tightened manually in an effort to adjustably secure the opposing end plates of the quilting frame into position, with respect to the legs. Conversely, the adjustment mechanism may be loosened with respect to the engagement between the support leg and the end plate to facilitate sliding movement in relation to the slotted opening, thus providing means for height adjustment of the quilting frame in relation to the working surface or table top.

In one presently preferred embodiment of the present invention, the support members engage selective locking mechanisms to facilitate the support members being selectively locked into or released from their engagement with the two opposing end plates. In this regard, the support members and the opposing end plates may be easily assembled and/or disassembled, thus facilitating ease of storage, compactibility and portability.

The support members selectively engage the locking mechanism at one or both ends thereof. In one presently preferred embodiment of the present invention, the locking mechanism comprises a ratchet. The ratchet preferably comprises a gear configured to interlock with a locking member (e.g., pawl) disposed in a corresponding location along the length of one or both of the opposing end plates, thereby allowing the support members to rotate in relation to the opposing end plates in only a single direction. In this manner, tension may be selectively applied and maintained along the length of the quilt engaging the support members to discourage sagging or slack. As appreciated, the locking members may be selectively disengaged from its locking engagement with the respective gear of the support members to allow the support members to turn freely in either direction, thereby allowing a user to add or remove fabric along the length of the support members.

BRIEF DESCRIPTION OF THE DRAWINGS

The foregoing and other objects and features of the present invention will become more fully apparent from the following description and appended claims, taken in conjunction with the accompanying drawings. Understanding that these drawings depict only typical embodiments of the invention and are, therefore, not to be considered limiting of its scope, the invention will be described with additional specificity and detail through use of the accompanying drawings in which:

DETAILED DESCRIPTION OF THE PREFERRED EMBODIMENTS

It will be readily understood that the components of the present invention, as generally described and illustrated in the Figures herein, could be arranged and designed in a wide variety of different configurations. Thus, the following more detailed description of the embodiments of the system and method of the present invention, as represented in FIGS. 1 through 6, is not intended to limit the scope of the invention, as claimed, but is merely representative of the presently preferred embodiments of the invention.

The presently preferred embodiments of the invention will be best understood by reference to the drawings, wherein like parts are designated by like numerals throughout.

Figure 1:
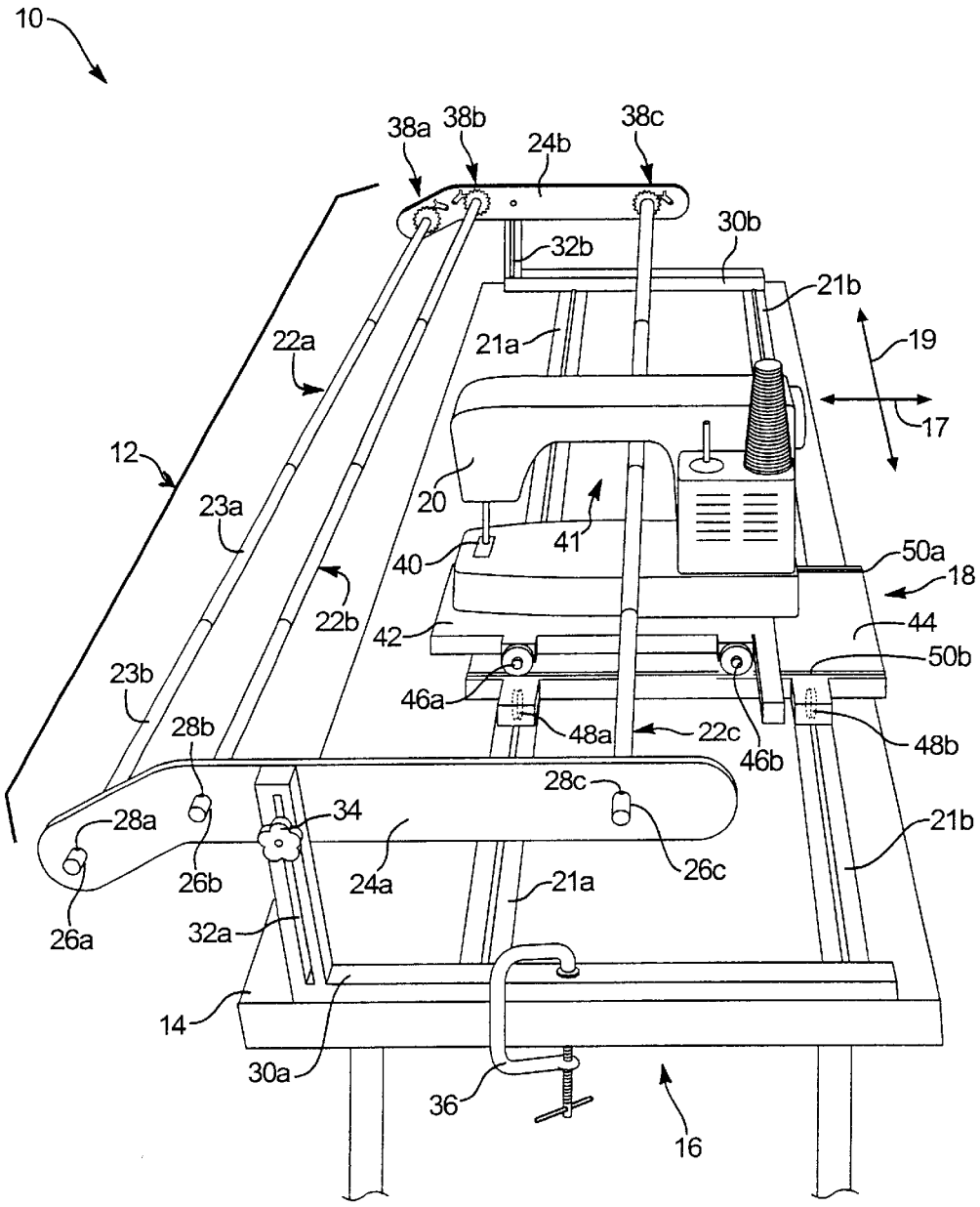
FIG. 1 is a perspective view of one presently preferred embodiment of a quilting apparatus in accordance with the present invention.
Figure 2:
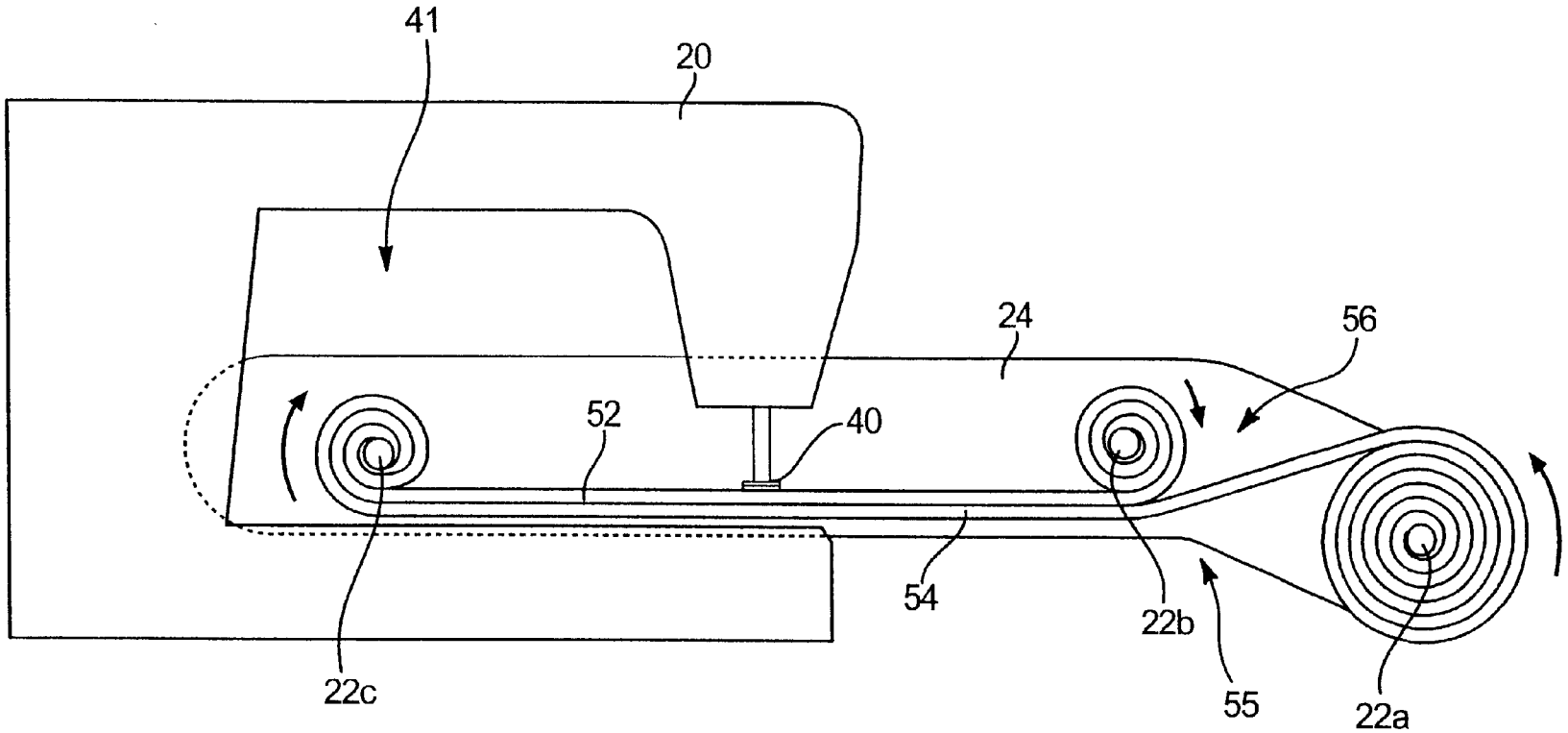
FIG. 2 is side sectional view illustrating one presently preferred embodiment of the relationship of the support members of a quilting frame to a sewing machine mountably disposed in relation to a carriage assembly in accordance with one presently preferred embodiment of the present invention.

One presently preferred embodiment of quilting apparatus of the present invention, designated generally at 10, is best illustrated in FIGS. 1 and 2. As shown, the quilting apparatus 10 includes a quilting frame 12 and a carriage assembly 18 configured to mountably support a sewing machine 20 having an arbitrary throat depth 41. Preferably, the quilting frame 12 is mounted relative to a working surface 14 and supportably retains one or more layers of fabric in a substantially planar orientation to accommodate sewing and stitching by the sewing machine 20. The carriage assembly 18 may be configured to transport the sewing machine 20 in both lateral and longitudinal directions 17, 19 with respect to the disposition of the fabric relative to the quilting frame 12. The maneuverability of the carriage assembly 18 relative to the length of the fabric forming the quilt provides a means for stitching patterns and/or designs into at least a portion of the body of the quilt.

A sufficient amount of tension may be applied to the fabric supported by the quilting frame 12 in an effort to facilitate proper alignment between the fabric to be sewn and stitched together to form a quilt having a desired size and shape. Preferably, the height of the quilting frame 12 may be adjusted with respect to the working surface 14 (e.g., table top) by means of a height adjustment assembly 16. In one presently preferred embodiment, the height adjustment assembly 16 comprises at least one support leg 30, a slotted opening formed in the length of the support leg 30, and an adjustable mechanism 34 that selectively engages the support leg 30 and the quilting frame 12 in a secure position relative to each other.

In one presently preferred embodiment of the present invention, the quilting frame 12 may comprise at least one elongated support member 22 and two opposing end plates 24. Preferably, two or more support members 22*a*, 22*b*, 22*c* are engageably disposed in relation to the opposing end plates 24*a*, 24*b*. The elongated support members 22*a*, 22*b*, 22*c* may comprise poles which act as spools for supportably engaging a length of the fabric comprising the quilt. Structurally, a first support member 22*a* may act as a spool for a lower layer of fabric, while a second support member 22*b* may act as a spool for an upper layer of fabric, as best shown in FIG. 2. One or more layers of padding or batting (not shown) may be introduced or fed between the first and second support members 22*a*, 22*b* for the purpose of inserting the same between the upper and lower layers of the fabric which comprises the quilt. Specifically, a portion of the length of the quilt may be selectively payed out or delivered by the first and second support members 22*a*, 22*b* which act as spools to a third support member 22*c* whereupon the finished portion of the quilt may be stored.

Referring back to FIG. 1, the two opposing end plates 24*a*, 24*b* of the quilting frame 12 may be configured to supportably retain opposing ends of the support members 22*a*, 22*b*, 22*c*, respectively. In one presently preferred embodiment of the present invention, the opposing end plates 24*a*, 24*b* of the quilting frame 12 may be formed of a sufficiently sturdy material. For example, the opposing end plates 24 may be formed of metal, wood, ceramic, fiberglass, graphite, any of numerous organic, synthetic or processed materials that are mostly thermoplastic or thermosetting polymers of high molecular weight, with or without additive, such as, plasticizers, auto oxidants, extenders, colorants, ultraviolet light stabilizers, or fillers, which can be shaped, molded, cast, extruded, drawn, foamed or laminated into objects, films, or filament, or any other composite materials or combinations thereof which are consistent with the spirit and scope of the present invention.

Receiving apertures 28*a*, 28*b*, 28*c* are preferably formed along the length of each of the end plates 24*a*, 24*b*. The receiving apertures 28*a*, 28*b*, 28*c* may also be disposed in a spaced-apart relationship to each other to provide a corresponding displacement between each of the support members 22*a*, 22*b*, 22*c*. The receiving apertures 28*a*, 28*b*, 28*c* are preferably configured having an internal periphery sufficient to receive an opposing end of a support member 22 and, accordingly, to provide a point of rotation for the engaging support member to selectively rotate in relation thereto.

A retention mechanism 28*a*, 28*b*, 28*c*, such as a biased locking pin, may be formed at the opposing ends of each of the support members 22*a*, 22*b*, 22*c*, respectively, to provide a means for selectively securing an engaging relationship between the support members 22 and the opposing end plates 24. Accordingly, this structural arrangement and design between the support members 22 and the opposing end plates 24 thereby allows each of the support members 22 to be easily assembled or disassembled from its engagement with the receiving apertures 26 of the opposing end plates 24, independent of each other, and collapsed for storage and ease of portability.

In one presently preferred embodiment of the present invention, the support members 22*a*, 22*b*, 22*c* may be formed of a sufficiently rigid material. For example, the support members 22*a*, 22*b*, 22*c* may be formed of metal, wood, ceramic, fiberglass, graphite, any of numerous organic, synthetic or processed materials that are mostly thermoplastic or thermosetting polymers of high molecular weight, with or without additive, such as, plasticizers, auto oxidants, extenders, colorants, ultraviolet light stabilizers, or fillers, which can be shaped, molded, cast, extruded, drawn, foamed or laminated into objects, films, or filament, or any other composite materials or combinations thereof which are consistent with the spirit and scope of the present invention. In addition, the elongated support members 22*a*, 22*b*, 22*c* may be configured having an extendable length.

Accordingly, the effective length of the support members 22*a*, 22*b*, 22*c* may be extendable, so that the quilting frame 12 may accommodate fabrics of various dimensions and be mounted on a working surface 14 having an arbitrary length. For example, the support members 22*a*, 22*b*, 22*c* may be telescopic, such as having telescopic sections 23*a*, 23*b*, or may simply have segments 23*a*, 23*b* which may be added or removed to increase and/or decrease the effective length of the support members 22*a*, 22*b*, 22*c*, as needed. In operational design, the support members 22*a*, 22*b*, 22*c* which are telescopic or provided in segments 23*a*, 23*b* may be collapsible and easily stored. As will be appreciated by those skilled in the art, the support members 22*a*, 22*b*, 22*c* engaging the opposing end plates 24*a*, 24*b* may, alternatively, be formed having a fixed length, if desired.

In one presently preferred embodiment of the present invention, the support members 22*a*, 22*b*, 22*c* engage selective locking mechanisms 38*a*, 38*b*, 38*c*, respectively, to facilitate the support members being selectively locked into or released from their engagement with the two opposing end plates 24*a*, 24*b*. In this regard, the support members 22*a*, 22*b*, 22*c* and the opposing end plates 24*a*, 24*b* may be easily assembled and/or disassembled to facilitate ease of storage, compactibility and portability.

Figure 4:
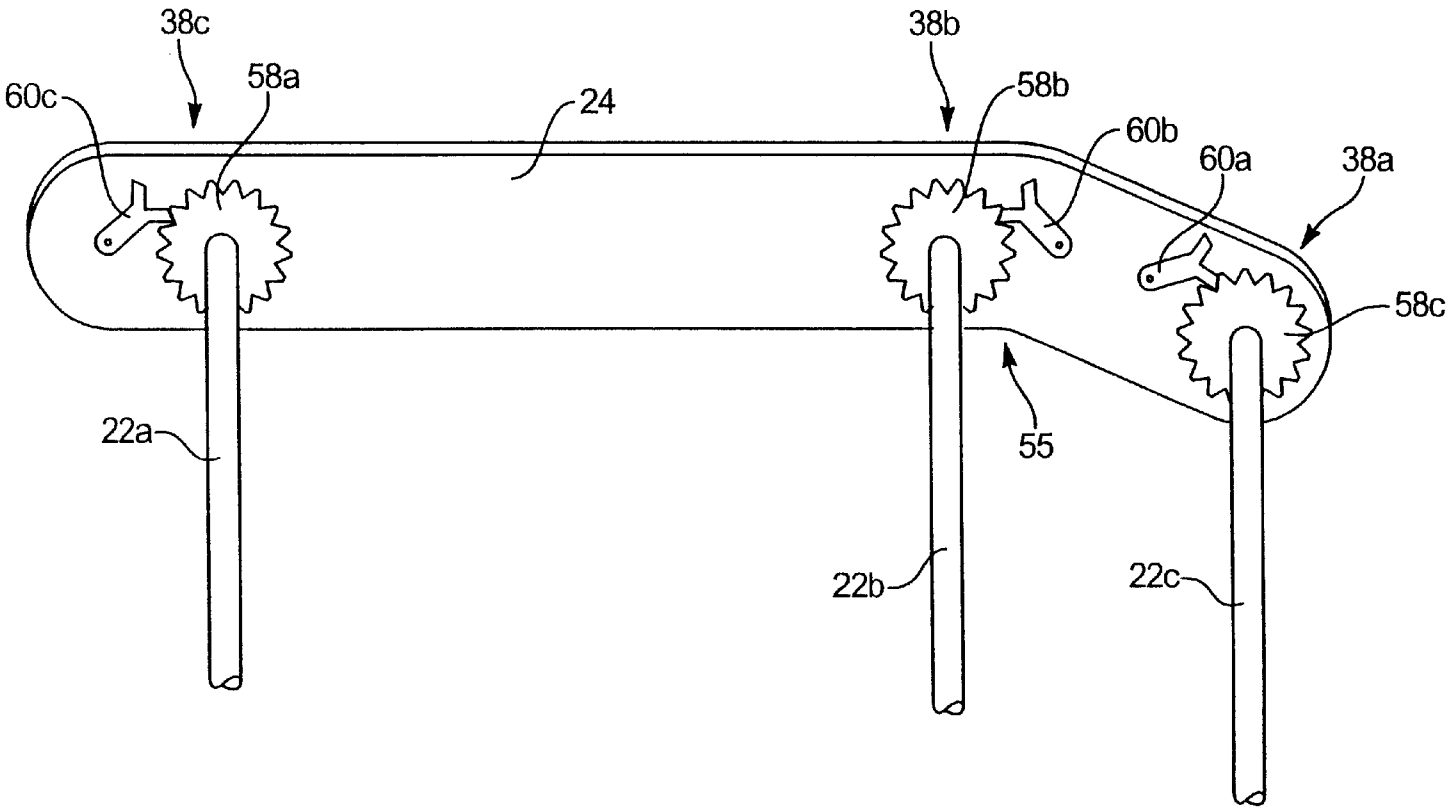
FIG. 4 is a perspective view of one presently preferred embodiment of a locking mechanism for retaining proper tension along the length of the quilt.

The support members 22*a*, 22*b*, 22*c* may selectively engage the locking mechanism 38*a*, 38*b*, 38*c* at one or both ends thereof. In one presently preferred embodiment of the present invention, the locking mechanism 38*a*, 38*b*, 38*c* comprises a ratchet. As best shown in FIG. 4, the ratchet preferably comprises a gear 58 configured to interlock with a locking member 60 (e.g., pawl) disposed in a corresponding location along the length of one or both of the opposing end plates 24*a*, 24*b*, thereby allowing the support members 22*a*, 22*b*, 22*c* to rotate in relation to the opposing end plates 24*a*, 24*b* in only a single direction. In this manner, tension may be selectively applied and maintained along the length of the fabric engaging the support members 22*a*, 22*b*, 22*c* in an effort to discourage sagging or slack in the quilt. As appreciated, the locking members 39 may be selectively disengaged from their locking engagement with a respective gear 58 of each of the support members 22*a*, 22*b*, 22*c* in order to allow the support members to turn freely in either direction. In this regard, fabric may be added or removed along the length of the support members 22*a*, 22*b*, 22*c*.

Referring now to FIG. 2, in one presently preferred embodiment of the present invention, the quilting apparatus 10 may store an upper fabric layer 52 of the quilt on the support member 22*b* and a lower fabric layer 54 of the quilt on the support member 22*a*. A portion of batting, filling or padding may also be fed in at an entry point 56 disposed between the upper and lower fabric layers 52, 54. In certain other embodiments, a portion of batting, filling or padding may be stored on a spool and selectively supplied between the upper and lower fabric layers 52, 54 of the quilt at the entry point 56. In other instances, a portion of batting, filling or padding may be stored together with the upper and lower layers 52, 54 of the quilt on either or both of the support members 22*a*, 22*b*.

In preferred operation, both the upper and lower fabric layers 52, 54 of the quilt are sewn or stitched by the needle of the sewing machine 20 mounted on the carriage assembly 18 and subsequently rotatably positioned for storage on the support member 22*c*. As best shown in FIG. 1, the support member 22*c* that preferably receives the quilted upper and lower fabric layers 52, 54 may pass through the length of the throat depth 41 of the sewing machine 20. In this regard, the upper and lower fabric layers 52, 54 may be moved from their supportable engagement with the support members 22*a*, 22*b* to the support member 22*c*.

Figure 3:
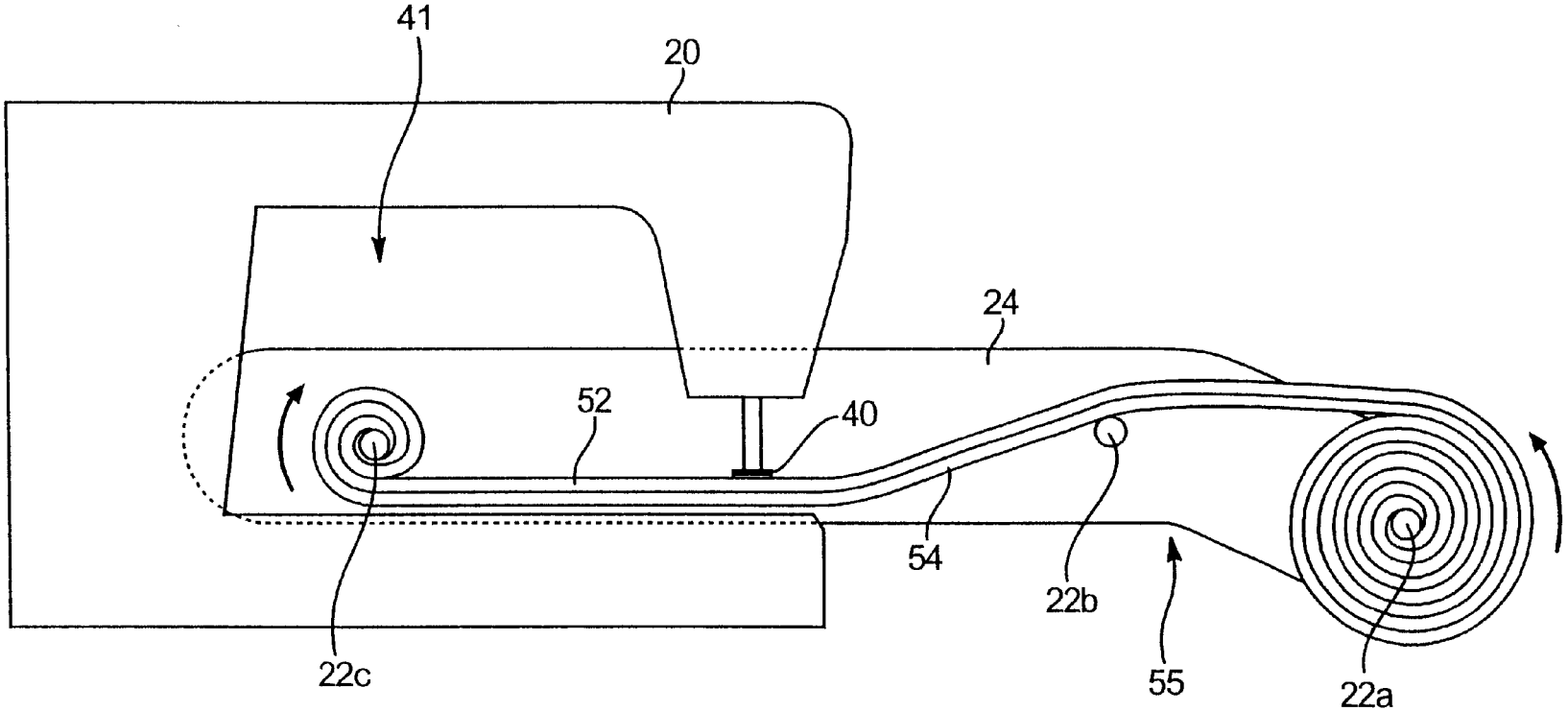
FIG. 3 is a side sectional view illustrating an alternative presently preferred embodiment of the relationship of the support members of a quilting frame to a sewing machine mountably disposed in relation to a carriage assembly.

Referring now to FIG. 3, in another presently preferred embodiment of the present invention, the upper and lower fabric layers 52, 54 of the quilt may be selectively stored on a single support member 22*a*. Specifically, this may include the upper and lower fabric layers 52, 54 of the quilt and any material inserted therebetween (e.g., batting, filling or padding). In certain instances, the fabric layers 52, 54 may be fed above or below the relative disposition of the support pole 22*b* according to the amount of material on the support pole 22*a* and in such manner so as to maintain alignment of the fabric layers 52, 54 in relation to the needle or foot 40 of the sewing machine 20.

In general operation, the support members 22*a*, 22*b* may be used in a variety of ways to accommodate movement of the upper and lower fabric layers 52, 54 of the quilt according to the nature of a project, including the amount of fabric being used, if the layers are separate or already together, and so forth. Referring to FIG. 4, an angular bend 55 may also be incorporated into either end of the opposing end plates 24*a*, 24*b* to ease the feeding of the fabric layer 54 through the throat depth 41 of the sewing machine 20, especially in cases where a large roll of fabric layers 52, 54, and possibly batting, are retained in selective engagement along the length of the support member 22*a*. Thus, the various structural components of the quilting apparatus 10 of the present invention provide a degree of versatility to a user.

Referring back to FIG. 1, the opposing end plates 24*a*, 24*b* of the quilting frame 12 may be supported by a height adjustment assembly 16. In one presently preferred embodiment of the present invention, the height adjustment assembly 16 comprises at least one leg 30*a*, 30*b* supporting each of the opposing end plates 24*a*, 24*b*. The support legs 30*a*, 30*b* may be formed having a length sufficient to facilitate an adjustment in the height of the quilting frame 12 with respect the working surface (e.g., table top) 14. Preferably, each support leg 30 may be formed having a general L-shaped configuration. In addition, each of the support legs 30, 30*b* may be structurally disposed in relation to at least a portion of the length of a respective end plate 24*a*, 24*b* and may be secured to the working surface 14 by means of a securing assembly 36. In certain presently preferred embodiments, the securing assembly 36 may include a clamp or bolt having arms that engage the working surface (e.g., table top) 14 and the support legs 30*a*, 30*b* which supportably engage the opposing end plates 24*a*, 24*b* of the quilting frame 12. Preferably, the support legs 30*a*, 30*b* may be adjustably attached to the respective end plates 24*a*, 24*b* of the quilting frame 12, thus permitting the quilting frame to be height adjusted with respect thereto.

In one presently preferred embodiment of the present invention, each of the support legs 30*a*, 30*b* may comprise a slotted opening 32*a*, 32*b* formed along a portion of its length, thus allowing the corresponding end plate 24*a*, 24*b* of the quilting frame 12 to be selectively slid along the length of the slotted opening 32*a*, 32*b*. An adjustment mechanism 34 (e.g., conventional fasteners, a friction knob, adjustable screw or the like) may be adjusted in an effort to selectively secure the opposing end plates 24*a*, 24*b* of the quilting frame 12 into a position with respect to the support legs 30*a*, 30*b*. Conversely, the adjustment mechanism 34 may be loosened with respect to its securing engagement between the support leg 30*a*, 30*b* and the end plate 24*a*, 24*b* in order to facilitate a sliding movement in relation to the slotted opening 32*a*, 32*b*, thus providing means for height adjustment of the quilting frame 12 in relation to the working surface (e.g., table top) 14. Therefore, the height of the quilting frame 12 (and the corresponding height of the fabric layers 52, 54 of the quilt being sewn) may be adjusted to an arbitrary height relative to the needle 40 of the sewing machine 20. To this end, it will be readily appreciated that other adjustment mechanisms may be constructed in accordance with the inventive principles set forth herein. It is intended, therefore, that the examples provided herein be viewed as exemplary of the principles of the present invention, and not as restrictive to a particular structure for implementing those principles.

As discussed hereinabove, the support members 22*a*, 22*b*, 22*c* may selectively engage the locking mechanisms 38*a*, 38*b*, 38*c* disposed at one or both ends thereof. The locking mechanisms 38*a*, 38*b*, 38*c* preferably function to restrict the rotation of the support members to a single direction, thereby providing a means for maintaining tension in the body of the fabric layers 52, 54.

In one presently preferred embodiment, each of the locking mechanism 38*a*, 38*b*, 38*c* comprises a ratchet, as best shown in FIGS. 1 and 4. Each of the ratchets 38*a*, 38*b*, 38*c* preferably comprises a gear 58*a*, 58*b*, 58*c* configured to interlock with a locking member (e.g., pawl) 60*a*, 60*b*, 60*c* disposed in a corresponding location along the length of one or both of the opposing end plates 24*a*, 24*b*, thereby allowing the support members 22*a*, 22*b*, 22*c* to rotate in relation to the opposing end plates 24*a*, 24*b* in a single direction. In this manner, tension may be selectively applied and maintained along the length of the fabric engaging the support members 22*a*, 22*b*, 22*c* in an effort to discourage sagging or slack in the fabric layers 52, 54 forming the quilt. As appreciated, the locking members 60*a*, 60*b*, 60*c* may be selectively disengaged from their locking engagement with the respective gear 58*a*, 58*b*, 58*c* of each of the support members 22*a*, 22*b*, 22*c* in order to allow the support members to turn freely in either direction. In this regard, fabric may be added or removed along the length of the support members 22*a*, 22*b*, 22*c*.

In one presently preferred embodiment of the present invention, the locking member (e.g., pawls) 60*a*, 60*b*, 60*c* may be connected to the opposing end plates 24*a*, 24*b* by any conventional fastener or other suitable pivot means sufficient to allow the locking member to selectively engage and disengage the respective gear 58*a*, 58*b*, 58*c* of the support member 22*a*, 22*b*, 22*c*. Similarly, the gears 58*a*, 58*b*, 58*c* may be connected to the opposing ends of the support members 22*a*, 22*b*, 22*c* by any conventional fastener sufficient to support a fixed relationship between the end of the respective support member and the gear.

In general, any means capable of selectively locking and unlocking the rotation of the support members 22*a*, 22*b*, 22*c*, including the use of electrical motors, may be employed by the quilting apparatus of the present invention and need not be limited to a ratchet mechanism herein described. To this end, it will be appreciated that other locking mechanisms may be constructed in accordance with the inventive principles set forth herein. It is intended, therefore, that the examples provided herein be viewed as exemplary of the principles of the present invention, and not as restrictive to a particular structure for implementing those principles.

Figure 5:
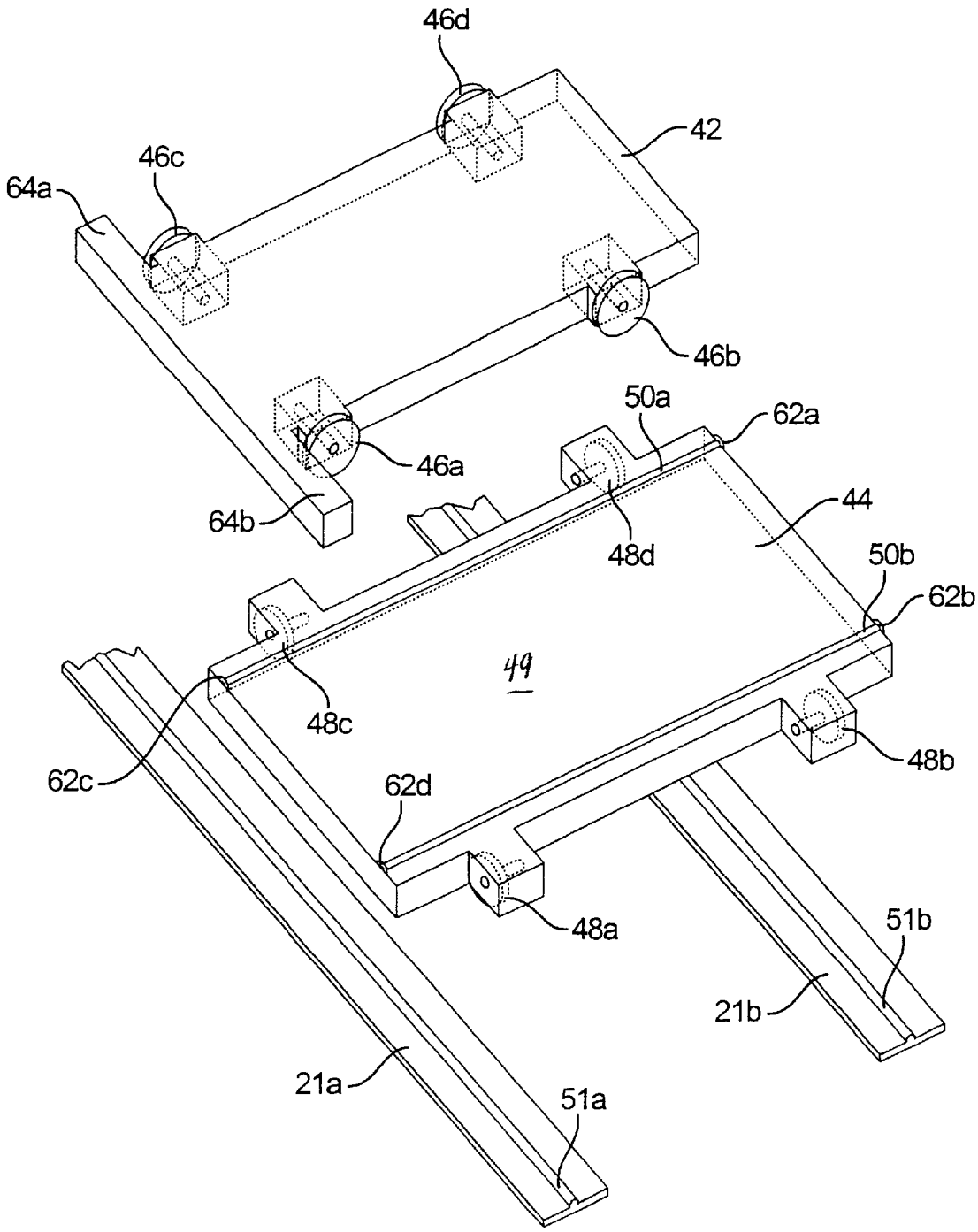
FIG. 5 is a perspective view of one presently preferred embodiment of a carriage assembly illustrating the structural relationship of an upper carriage component, a lower carriage component and a first and second track providing means for assisting with the maneuverability of the carriage assembly relative to a quilting frame.

Referring now to FIGS. 1 and 5, the carriage assembly 18 may be used to maneuver the sewing machine 20 with respect to the fabric layers 52, 54 forming the quilt and supportably mounted between the support members 22*a*, 22*b*, 22*c* of the quilting frame 12. Preferably, the carriage assembly 18 is formed of a sufficiently rigid material. For example, the carriage assembly 18 may be formed of metal, wood, ceramic, fiberglass, graphite, any of numerous organic, synthetic or processed materials that are mostly thermoplastic or thermosetting polymers of high molecular weight, with or without additive, such as, plasticizers, auto oxidants, extenders, colorants, ultraviolet light stabilizers, or fillers, which can be shaped, molded, cast, extruded, drawn, foamed or laminated into objects, films, or filament, or any other composite materials or combinations there of which are consistent with the spirit and scope of the present invention.

In one presently preferred embodiment of the present invention, the carriage assembly 18 may include an upper carriage component 42 and a lower carriage component 44 which are capable of manual and/or automated manipulation to facilitate the maneuverability of the sewing machine 20 in both lateral and longitudinal directions 17, 19 respective to the quilting frame 12. Consistent with the novel adjustable working components of the quilting apparatus 10 of the present invention, the quilting frame 12 may be supported or mounted on any suitable working surface 14 having an arbitrary length and providing a substantially smooth upper surface. The working surface 14 preferably includes a table top. The longitudinal dimension of the quilting frame 12 may therefore be adjustable to the length of the working surface (e.g., table top) 14, as desired.

More particularly, in one presently preferred embodiment of the present invention, the carriage assembly 18 is configured to transport the sewing machine 20 of arbitrary throat depth 41 along the length of one or more layers of fabric 52, 54 comprising the quilt, wherein the quilt has a length which supportably engages the elongated support members of the quilting frame 12 mounted in relation to the working surface (e.g., table top) 14. The sewing machine 20, as contemplated herein, may include a wide variety of conventional sewing machines currently available in the marketplace. Functionally, the carriage assembly 18 provides means for moving the sewing machine 20 with respect to the fabric layers 52, 54, along both the lateral and longitudinal dimensions thereof, for the purpose of applying stitching, including both patterns and designs, to at least a portion of the body of the quilt.

In certain presently preferred embodiments, the carriage assembly 18 includes an upper carriage component 42 and a corresponding lower carriage component 44. The lower carriage component 44 may be responsible for selectively transporting the sewing machine 20 along the longitudinal dimension 19 of the quilting frame 12. With respect thereto, the upper carriage component 42 may preferably move along an upper surface 49 of the lower carriage component 44 and be configured to selectively transport the sewing machine 20 along the lateral dimension 17 of the quilting frame 12.

As will be appreciated, in one presently preferred alternate embodiment of the present invention, a carriage assembly (not shown) may not include upper and lower carriage components, but rather be formed as a single, unitary member, translatable with respect to both the later and longitudinal dimensions of the quilting frame. Moreover, one or more electric motors (not shown) may be provided in conjunction with the movement of the carriage assembly to facilitate controlled movements of the sewing machine mounted in relation to the carriage assembly.

At least one length of track 21 may be used to retain the carriage assembly 18 properly aligned on the working surface (e.g., table top) 14. Preferably, two pieces of track

21*a*, 21*b* may be mounted on the working surface 14 in order to restrict the movement of the lower carriage component 44 in a predefined direction along the longitudinal dimension 19 of the quilting frame 12. In one presently preferred embodiment of the present invention, the track 21*a*, 21*b* may be provided in segments 23*a*, 23*b*, thereby allowing a user to adjust the length of the track according to the corresponding width of the fabric layers 52, 54 comprising the quilt and/or to fit the length of a working surface (e.g. table top) 14. The runners 50*a*, 50*b* may be attached to the table surface 14 or working surface 14 by any suitable means, including tape, adhesive, screws, or the like. In addition, a second track 50*a*, 50*b* may be formed along the upper surface 49 of the lower carriage component 44 to guide the upper carriage component 42 in a predefined directional relation thereto. For example, the track 50*a*, 50*b* formed in the upper surface 49 of the lower carriage component 44 may restrict the movement of the upper carriage component 42 to the direction defined by the lateral dimension 17 of the quilting frame 12. Additionally, the second track 50*a*, 50*b* may comprise end stops or abutments 62 having a dimension sufficient to prevent the upper carriage component 42 from becoming disengaged from its relation to the lower carriage component 44.

A plurality of rollers (e.g., wheels) 48*a*, 48*b*, 48*c*, 48*d* may be incorporated into the structural design of the lower carriage component 44 for engaging the track 21*a*, 21*b* mounted in relation to the working surface 14, thus providing means for maneuvering the sewing machine 20 mounted in relation to the carriage assembly 18 in the longitudinal direction 19 of the quilting frame 12. Similarly, a plurality of rollers (e.g., wheels) 46*a*, 46*b*, 46*c*, 46*d* may be incorporated into the structural design of the upper carriage component 42 for engaging the track 50*a*, 50*b* formed in the upper surface 49 of the lower carriage component 44, thus providing means for maneuvering the sewing machine 20 mounted in relation to the carriage assembly 18 in the lateral direction 17 of the quilting frame 12.

In one presently preferred embodiment, the track 21*a*, 21*b* mounted in relation to the working surface 14 may include a guide (e.g., raised rib) 51*a*, 51*b* formed along at least a portion of the length of its upper surface. The rib 51*a*, 51*b* is preferably configured having a dimensional periphery sufficient to engage a recessed portion of the wheels 48*a*, 48*b*, 48*c*, 48*d* of the lower carriage component 44 in a mountable relation thereon. In an alternate presently preferred embodiment, the guide 51*a*, 51*b* may comprise a recess (not shown). The recess may be formed along at least a portion of the length of the upper surface of the track 21. Preferably, the recess may be configured having a dimensional periphery sufficient to engage a corresponding leading portion of the wheels 48*a*, 48*b*, 48*c*, 48*d* of the lower carriage component 44 in a mountable relation thereto. It will be appreciated that other means for guiding 51 the rollers 46, 48 of the upper and lower carriage components may be constructed in accordance with the inventive principles set forth herein. It is intended, therefore, that the examples provided herein be viewed as exemplary of the principles of the present invention, and not as restrictive to a particular structure for implementing those principles.

Additionally, the upper carriage component 42 may include one or more handles 64*a*, 64*b* to facilitate an ease in manually maneuverability of the carriage assembly 18 and corresponding mounted sewing machine 20 in the linear and longitudinal directions 17, 19 of the quilting frame 12 along the tracks 21*a*, 21*b*, 50*a*, 50*b* to stitch or sew patterns or designs in the fabric layers 52, 54 comprising the quilt.

Figure 6:
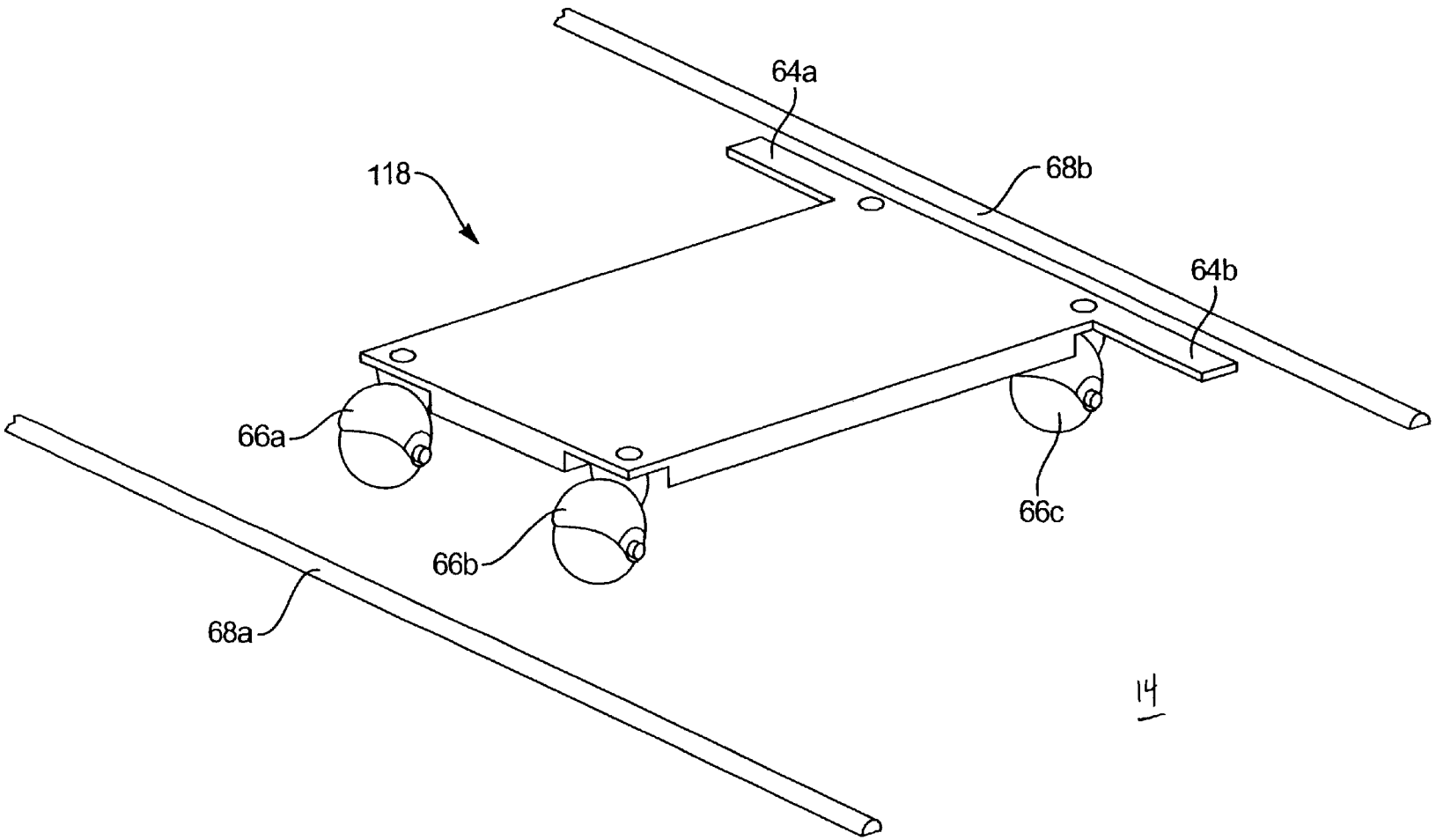
FIG. 6 is a perspective view of one presently preferred alternative embodiment of a carriage assembly having casters adapted in relation thereto to facilitate the maneuverability of the carriage assembly relative to a quilting frame.

Referring now to FIGS. 2 and 6, in one presently preferred alternate embodiment of the present invention, a carriage assembly 118 may not include upper and lower carriage components, but rather be formed as a single, unitary member translatable with respect to both the later and longitudinal directions 17, 19 of the fabric layers 52, 54 forming the quilt mounted in relation to the support members 22*a*, 22*b*, 22*c* of the quilting frame 12. At least one and preferably a plurality of casters 66*a*, 66*b*, 66*c*, 66*d* may be incorporated into the structural design of the carriage assembly 118 for engaging the working surface 14, thus providing means for maneuvering the sewing machine 20 mounted in relation to the carriage assembly 118 in the lateral and longitudinal directions 17, 19 of the quilting frame 12. The carriage assembly 118 may include one or more handles 64*a*, 64*b* to facilitate an ease in manually maneuverability of the carriage assembly 18 and corresponding mounted sewing machine 20 in relation to the fabric layers 52, 54 forming the quilt. In certain alternate embodiments of the present invention, motors (not shown) may be provided in conjunction with controlling the movement of the carriage assembly 118 relative to the quilting frame 12. To assist in providing a form of controlled movement, tracks 68*a*, 68*b* may be mounted in relation to the working surface 14 in an effort to restrict the overall maneuverability of the carriage assembly 18 relative to the working surface (e.g., table top) 14 and the quilting frame 12.

Referring now to one presently preferred method for guiding a sewing machine relative to at least one layer of fabric mounted on a quilting frame, the method comprising the steps of: (1) mounting the quilting frame with respect to the working surface; (2) spooling at least a portion of one or more fabric layers in relation to support members of the quilting frame; (3) paying out the fabric layers in a substantially planar orientation with the quilting frame defined by lateral and longitudinal dimensions, wherein the longitudinal dimension of the quilting frame being selectively adjustable to the length of the working surface; and (4) guiding the sewing machine with respect to the fabric along both the lateral and longitudinal dimensions of the quilting frame by means of a carriage assembly supported by the working surface.

In addition, one presently preferred method of the present invention may comprise the additional steps of adjusting the height of the quilting frame with respect to the working surface and selectively restricting the rotation of the support member of the quilting frame in a single direction to provide a suitable amount of tension in the fabric layers forming the quilt.

In structural design, the various working components of the quilting apparatus are preferably formed of a lightweight polymeric material to facilitate an ease in portability and are configured in such a manner so as to be easily assembled and disassembled for compactibility and storage.

From the above discussion, it will be readily appreciated that the present invention provides a quilting apparatus and methods for using the same having many of the advantages of "long arm" quilting assemblies, while providing a greater degree of simplicity, affordability, and flexibility to a user. In addition, the present invention provides a quilting apparatus that makes use of a sewing machine of arbitrary throat depth being positionable on a carriage assembly and which is capable of providing the sewing or stitching mechanism for the quilt.

Unlike prior quilting assemblies, the present invention provides a quilting apparatus having a quilting frame that is mountable to a wide variety of ordinary table tops having different dimensions, wherein the quilting frame is adjustable in its overall dimensional width and length with respect to the table top. Similarly, the present invention provides a quilting apparatus that is sufficiently lightweight for portability and collapsible for easy storage.

The present invention may be embodied in other specific forms without departing from its spirit or essential characteristics. The described embodiments are to be considered in all respects only as illustrative, and not restrictive. The scope of the invention is, therefore, indicated by the appended claims, rather than by the foregoing description. All changes which come within the meaning and range of equivalency of the claims are to be embraced within their scope.

What is claimed and desired to be secured by United States Letters Patent is:

1. A quilting apparatus for guiding a sewing machine relative to at least one layer of fabric, the quilting apparatus comprising:

a quilting frame configured to selectively take in and pay out the fabric in a substantially planar orientation defined by lateral and longitudinal dimensions, the quilting frame being mountable with respect to a working surface, and wherein the longitudinal dimension of the quilting frame being selectively adjustable to a length of the working surface; and a carriage assembly supported by the working surface and configured to selectively transport the sewing machine with respect to the fabric along the lateral and longitudinal dimensions of the quilting frame.

2. The quilting apparatus as defined in claim 1, wherein the carriage assembly comprises a first carriage component configured to transport the sewing machine along the longitudinal dimension of the quilting frame.

3. The quilting apparatus as defined in claim 2, further comprising a track configured to mount on the working surface and restrict movement of the first carriage component to the direction defined by the longitudinal dimension of the quilting frame.

4. The quilting apparatus as defined in claim 3, wherein the first carriage component comprises wheels configured to move along the track.

5. The quilting apparatus as defined in claim 2, wherein the carriage assembly further comprises a second carriage component supportably mounted in relation to the first carriage component and being movable with respect thereto, the second carriage component configured to transport the sewing machine along the lateral dimension of the quilting frame.

6. The quilting apparatus as defined in claim 5, wherein the first carriage component comprises an upper surface having a track formed along a length thereof and configured to restrict movement of the second carriage component to the direction defined by the lateral dimension of the quilting frame.

7. The quilting apparatus as defined in claim 6, wherein the second carriage component comprises wheels configured to move along the length of the track formed on the upper surface of the first carriage component.

8. The quilting apparatus as defined in claim 6, wherein the track comprises structural stops formed at opposing ends thereof.

9. The quilting apparatus as defined in claim 1, wherein the quilting frame comprises at least one support member having a length extending along the longitudinal dimension, the support member being configured to act as a spool for storing at least a portion of the fabric thereon, wherein the length of the support member is selectively adjustable to the length of the working surface.

10. The quilting apparatus as defined in claim 9, wherein the quilting frame further comprises two opposing end plates extending along the lateral dimension, each of the end plates comprising receiving apertures formed therein and at a spaced-apart relationship to each other, wherein the receiving apertures are configured to engageably receive the support members.

11. The quilting apparatus as defined in claim 10, wherein the end plates are configured having an angular bend formed at one end.

12. The quilting apparatus as defined in claim 10, wherein the support member comprises opposing ends having a locking member adapted to selectively lock relative to the receiving apertures of the opposing end plates.

13. The quilting apparatus as defined in claim 9, further comprising a locking mechanism configured to restrict rotation of the support member in a single direction.

14. The quilting apparatus as defined in claim 13, wherein the locking mechanism comprises a ratchet.

15. The quilting apparatus as defined in claim 1, further comprising a height adjustment assembly configured to facilitate height adjustment of the quilting frame with respect to the working surface.

16. The quilting apparatus as defined in claim 15, wherein the height adjustment assembly comprises at least one support leg configured to selectively engage the quilting frame.

17. The quilting apparatus as defined in claim 16, wherein the support leg comprises a slotted opening.

18. The quilting apparatus as defined in claim 17, wherein the quilting frame comprises an adjustable mechanism configured to engage the slotted opening of the support leg.

19. A method for guiding a sewing machine relative to at least one layer of fabric mounted on a quilting frame, the method comprising the steps of:

paying out the fabric in a substantially planar orientation with the quilting frame defined by lateral and longitudinal dimensions, the quilting frame being mountable with respect to a working surface, and wherein the longitudinal dimension of the quilting frame being selectively adjustable to the length of the working surface; and guiding the sewing machine with respect to the fabric along both the lateral and longitudinal dimensions of the quilting frame by means of a carriage assembly supported by the working surface.

20. The method as defined in claim 19, further comprising the step of spooling the fabric supported by the quilting frame to maintain tension.

21. The method as defined in claim 19, further comprising the step of adjusting the height of the quilting frame with respect to the working surface.

22. The method as defined in claim 21, wherein the step of adjusting the height of the quilting frame comprises at least one support leg configured to selectively engage the quilting frame.

23. The method as defined in claim 22, wherein the support leg comprises a slotted opening.

24. The quilting apparatus as defined in claim 23, wherein the quilting frame comprises an adjustable mechanism configured to engage the slotted opening of the support leg.

25. The method as defined in claim 19, wherein the carriage assembly comprises a first carriage component configured to transport the sewing machine along the longitudinal dimension of the quilting frame.

26. The method as defined in claim 25, further comprising a track configured to mount on the working surface and restrict movement of the first carriage component to the direction defined by the longitudinal dimension of the quilting frame.

27. The method as defined in claim 26, wherein the first carriage component comprises wheels configured to move along the track.

28. The method as defined in claim 25, wherein the carriage assembly further comprises a second carriage component supportably mounted in relation to the first carriage component and being movable with respect thereto, the second carriage component configured to transport the sewing machine along the lateral dimension of the quilting frame.

29. The method as defined in claim 28, wherein the first carriage component comprises an upper surface having a track formed along a length thereof and configured to restrict movement of the second carriage component to the direction defined by the lateral dimension of the quilting frame.

30. The method as defined in claim 29, wherein the second carriage component comprises wheels configured to move along the length of the track formed on the upper surface of the first carriage component.

31. The method as defined in claim 29, wherein the track comprises structural stops formed at opposing ends thereof.

32. The method as defined in claim 19, wherein the quilting frame comprises at least one support member having a length extending along the longitudinal dimension, the support member being configured to act as a spool for storing at least a portion of the fabric thereon, wherein the length of the support member is selectively adjustable to the length of the working surface.

33. The method as defined in claim 32, wherein the quilting frame further comprises two opposing end plates extending along the lateral dimension, each of the end plates comprising receiving apertures formed therein and at a spaced-apart relationship to each other, wherein the receiving apertures are configured to engageably receive the support members.

34. The method as defined in claim 32, wherein the support member comprises opposing ends having a locking member adapted to selectively lock relative to the receiving apertures of the opposing end plates.

35. The quilting apparatus as defined in claim 32, further comprising a locking mechanism configured to restrict rotation of the support member in a single direction.

36. The quilting apparatus as defined in claim 35, wherein the locking mechanism comprises a ratchet.

* * * * *

UNITED STATES PATENT AND TRADEMARK OFFICE

CERTIFICATE OF CORRECTION

PATENT NO. : 6,615,756 B2
DATED : September 9, 2003
INVENTOR(S) : Laurel W. Barrus It is certified that error appears in the above-identified patent and that said Letters Patent is hereby corrected as shown below:

Title page,
Item [57], ABSTRACT, please delete the abstract and replace it with
-- A quilting apparatus and method for guiding a sewing machine relative to at least one layer of fabric is disclosed. The apparatus may include an adjustable quilting frame and a carriage assembly that supports the sewing machine. The quilting frame is mounted relative to a working surface and retains one or more fabric layers in a substantially planar orientation. The carriage assembly includes lower and upper carriage components that cooperate to transport the sewing machine in lateral and longitudinal directions with respect to the quilting frame. The quilting frame includes support members acting as spools to retain the fabric layers and having locking mechanisms for maintaining tension in the fabric layers. The support members have an adjustable length to accommodate various fabric sizes and to accommodate the arbitrary dimensions of the working surface. The height of the quilting frame may also be adjusted by a height adjustment assembly. --

Column 1,
Line 49, please delete “atypical” and replace it with -- a typical --.

Column 15,
Line 23, please delete “being mountale” and replace it with -- being removably mountable --.

Column 16,
Line 40, please delete “being mountable” and replace it with -- being removably mountable --.

Column 18,
Line 20, please delete Claim 35 and replace it with -- The method as defined in claim 32, wherein the quilting frame further comprises a locking mechanism configured to restrict rotation of the support member in a single direction. --.

UNITED STATES PATENT AND TRADEMARK OFFICE

CERTIFICATE OF CORRECTION

PATENT NO. : 6,615,756 B2
DATED : September 9, 2003
INVENTOR(S) : Laurel W. Barrus It is certified that error appears in the above-identified patent and that said Letters Patent is hereby corrected as shown below:

Column 18 (cont'd),
Line 23, please delete Claim 36 and replace it with -- The method as defined in claim 35, wherein the locking mechanism comprises a ratchet. --.

Signed and Sealed this

First Day of June, 2004

JON W. DUDAS
*Acting Director of the United States Patent and Trademark Office*